United States Patent [19]

Kao et al.

[11] Patent Number: 4,915,288

[45] Date of Patent: Apr. 10, 1990

[54] ENVELOPE WITH SINGLE PEEL-OFF BACKING SHEET TO FACILITATE PRINTING AND COPYING

[75] Inventors: Kim Y. Kao, Irvine; Stefan C. Wegdell, Tustin, both of Calif.; Wayne L. Rutkowski, South Wales, N.Y.

[73] Assignee: Avery International Corporation, Pasadena, Calif.

[21] Appl. No.: 344,615

[22] Filed: Apr. 27, 1989

[51] Int. Cl.[4] ..... B65D 27/14

[52] U.S. Cl. ..... 229/80

[58] Field of Search ..... 229/80, 92.1, 92.7

[56] References Cited

U.S. PATENT DOCUMENTS

| | | |
|---|---|---|
| Re. 20,615 | 1/1938 | Bear et al. . |
| 22,405 | 12/1858 | Arnold . |
| 50,549 | 10/1865 | Barrett . |
| 180,200 | 7/1876 | Chapman . |
| 225,319 | 3/1880 | Barton . |
| 442,841 | 12/1890 | West . |
| 494,170 | 2/1893 | Sewell . |
| 512,505 | 1/1894 | Dale . |
| 531,832 | 1/1895 | Brown . |
| 660,141 | 10/1900 | Bartelmez . |
| 693,624 | 2/1902 | Sallade . |
| 730,933 | 6/1903 | Lanson . |
| 754,373 | 3/1904 | Jones . |
| 761,004 | 5/1904 | Meadows . |
| 761,912 | 6/1904 | Rheutan . |
| 783,365 | 2/1905 | Coleman . |
| 985,061 | 2/1911 | Regenstein . |
| 1,013,571 | 1/1912 | Stevens . |
| 1,014,441 | 1/1912 | Benton . |
| 1,045,001 | 11/1912 | Delffs . |
| 1,091,172 | 3/1914 | Thayer . |
| 1,110,939 | 9/1914 | Jones . |
| 1,126,784 | 2/1915 | Kittka . |
| 1,159,719 | 11/1915 | Shuman . |

(List continued on next page.)

FOREIGN PATENT DOCUMENTS

| | | | |
|---|---|---|---|
| 691965 | 8/1964 | Canada . | |
| 43179 | 1/1982 | European Pat. Off. . | |
| 631006 | 5/1936 | Fed. Rep. of Germany . | |
| 951226 | 6/1947 | France . | |
| 2572364 | 8/1984 | France . | |
| 43404 | 5/1938 | Netherlands . | |
| 88/05410 | 7/1988 | PCT Int'l Appl. | 229/80 |
| 4768 | 3/1892 | Switzerland . | |
| 24562 | of 1904 | United Kingdom . | |
| 0500439 | 2/1939 | United Kingdom | 229/80 |
| 921378 | 3/1963 | United Kingdom . | |
| 1475304 | 6/1977 | United Kingdom . | |
| 2115744 | 9/1983 | United Kingdom . | |

*Primary Examiner*—Stephen Marcus
*Assistant Examiner*—K. M. Stemann
*Attorney, Agent, or Firm*—Poms, Smith, Lande & Rose

[57] ABSTRACT

An envelope having a single peel-off backing sheet covering strips of pressure sensitive adhesive located along the sides of a panel of the envelope, which facilitates processing through automatic mechanical sheet feed printing equipment, laser printing equipment and feed through copy machines prior to folding the panel in order to form an envelope. Before the panel is folded, the panel, peel-off backing sheet, and peel-off strip attached to an adhesive strip on the envelope's closure flap provide a flat sheet of uniform thickness which can be easily processed through printing and copying equipment. After indicia is printed on the panel or copying is completed, an envelope may be formed by peeling the single backing sheet off the pressure sensitive strips, folding the envelope about a fold line located near the middle of the panel, and pressing the strips of pressure sensitive adhesive at the sides of the panel together so that a pocket is formed for holding a letter or other document. The strip covering the adhesive on the closure flap is then peeled off and the closure flap is folded about another fold line at the bottom of the flap allowing the adhesive on the flap to be pressed against the panel and the flap to be closed. The peel-off backing sheet preferably has a silicone coating on only one side thereof which allows a person to write or print on the other side of the backing sheet, allowing the sheet to be used as stationery or a letter.

20 Claims, 2 Drawing Sheets

U.S. PATENT DOCUMENTS 1,163,459 12/1915 Rheutan .
1,164,606 12/1915 Wittmann .
1,310,188 7/1919 Hogan .
1,459,092 6/1923 Etheridge .
1,529,264 3/1925 Mayers .
1,957,704 5/1934 Drachman .
2,142,374 1/1939 Randolph .
2,152,135 3/1939 Case et al. .
2,213,729 9/1940 Anderson .
2,219,526 10/1940 McLaren .
2,220,231 11/1940 Gilfillan .
2,304,523 12/1942 Young .
2,442,091 5/1948 Mann et al. .
2,610,784 9/1952 Henry .
3,063,618 11/1962 Berkowitz .
3,070,280 12/1962 Puchmond ..... 229/80
3,093,296 6/1963 Wood .
3,197,121 7/1965 Hayes, Jr. .
3,265,289 8/1966 Hiersteiner .
3,341,109 9/1967 Ellenbogen ..... 229/80
3,372,861 3/1968 Johnson .
3,414,185 12/1968 Young .
3,428,237 2/1969 Dowen .
3,467,299 9/1969 Meyer .
3,557,519 1/1971 Lyon .
3,626,821 12/1971 Gendron .
3,648,923 3/1972 Young .
3,666,926 5/1972 Conte, Jr. et al. .
3,802,618 4/1974 Wiessner .
3,900,159 8/1975 Gendron .
3,937,492 2/1976 Biron .
4,004,728 1/1977 Ryan et al. .
4,031,818 6/1977 Kehoe .
4,044,942 8/1977 Sherwood .
4,128,954 12/1978 White .
4,199,630 4/1980 Consiglio .
4,305,506 12/1981 Greenwald .
4,313,557 2/1982 Foffel .
4,380,315 4/1983 Steidinger .
4,502,713 3/1985 Conti .
4,630,768 12/1986 Bradley .
4,690,322 9/1987 Burns ..... 229/80
4,715,531 12/1987 Stewart et al. ..... 229/92.1
4,807,805 2/1989 Rutkowski ..... 229/80

FIG. 1
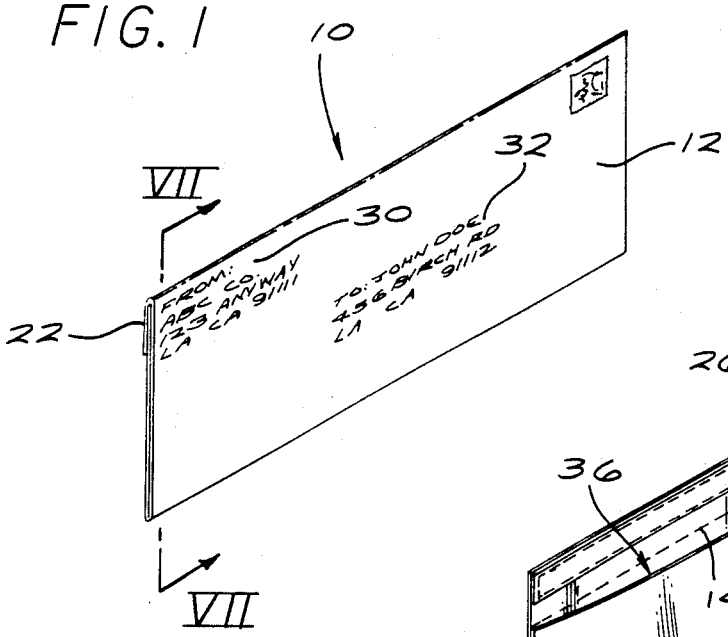
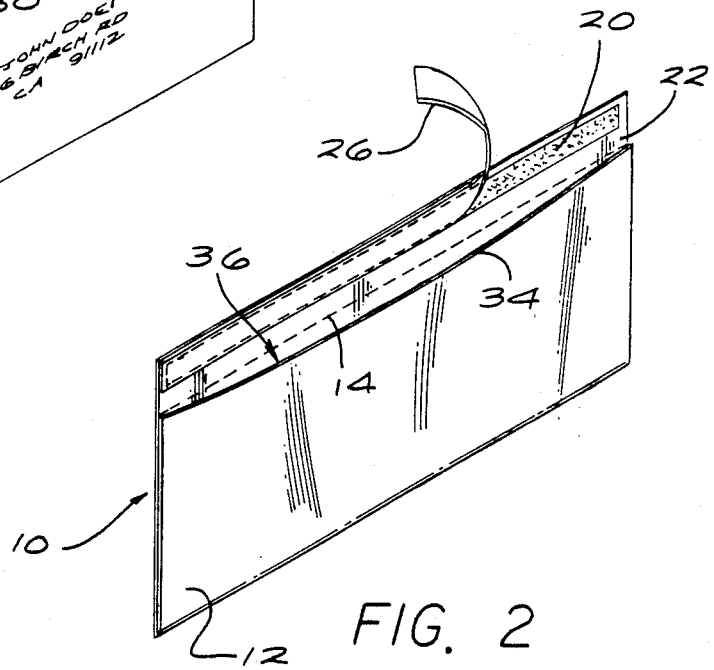
FIG. 2
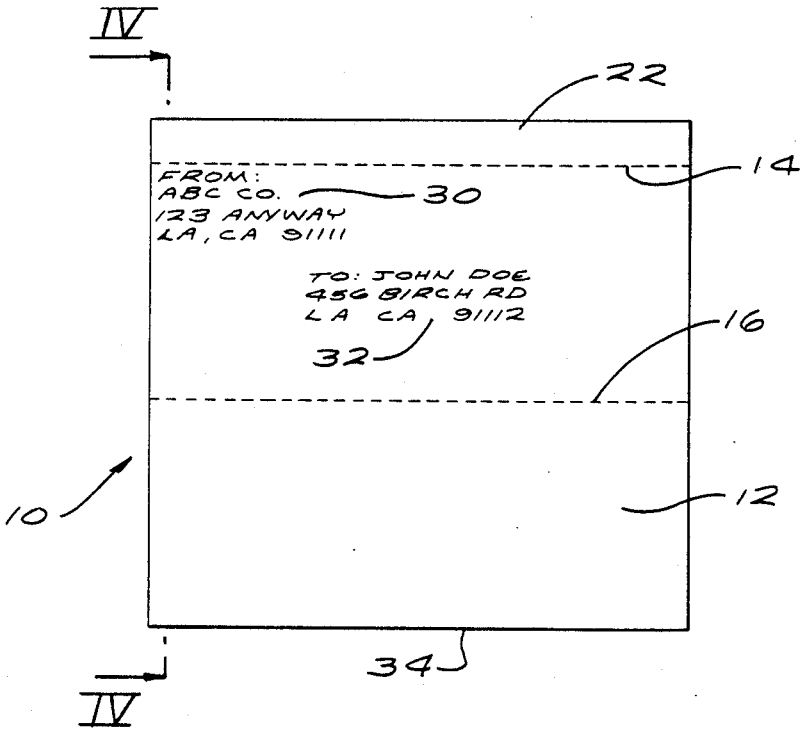
FIG. 3

ENVELOPE WITH SINGLE PEEL-OFF BACKING SHEET TO FACILITATE PRINTING AND COPYING

CROSS-REFERENCE TO RELATED APPLICATION

The subject matter of this application is related to the subject matter of co-pending application, Ser. No. 07/005,458, filed by Wayne L. Rutkowski on Jan. 20, 1987, entitled "Dual Envelope Sheet Feed Assembly," and assigned to Avery International Corporation, the assignee of the present application.

BACKGROUND OF THE INVENTION

The present invention relates generally to envelopes and, more particularly, to an envelope having a single peel-off backing sheet having strips of pressure sensitive adhesive located along the sides of a panel of the envelope, which facilitates processing through automatic mechanical sheet feed printing equipment, laser printing equipment and feed through copy machines prior to folding the panel in order to form an envelope. The single peel-off backing sheet preferably has a silicone coating on only one side which allows a person to print or write on the other side of the backing sheet. As such, the backing sheet may be used as stationery or a letter which may be placed inside the envelope.

In the past, difficulties have resulted in attempts to process envelopes through automatic mechanical printing equipment, laser printing equipment and copying machines because the envelopes were not of uniform thickness when folded as a result of overlapping closure flaps or other overlapping portions of the envelopes, or due to peel-off or release strips used to cover pressure sensitive adhesives or other types of adhesives in order to prevent the adhesives from being activated during high printing temperatures. For example, U.S. Pat. No. 4,715,531 discloses an envelope using a number of release strips to cover strips of adhesive, which leads to an envelope of variable thickness that causes problems during copying and printing.

SUMMARY OF THE INVENTION

The above problems would be solved by an envelope using a single peel-off backing sheet which is the same size as the envelope panel and is used to cover strips of pressure sensitive adhesive on the panel providing an unfolded envelope of uniform thickness that may be easily processed through automatic mechanical printing equipment, laser printing equipment and copying machines prior to folding the panel in order to form an envelope.

It is an object of this invention to provide an envelope which may be easily processed through automatic mechanical sheet feed printing equipment, laser printing equipment and feed through copy machines.

It is still another object of this invention to provide an envelope of uniform thickness that facilitates printing and copying prior to folding of the envelope for use in the mails.

It is still another object of the invention to provide an envelope with a single peel-off backing sheet that has a silicone coating on only one side which allows a person to print or write on the other side of the backing sheet so that the sheet may be used as stationery or a letter.

It is still another object of this invention to provide an envelope that is economical to manufacture.

These and other objects and advantages are attained by an envelope having a single peel-off backing sheet covering strips of pressure sensitive adhesive located along the sides of a panel of the envelope, which facilitates processing through automatic mechanical sheet feed printing equipment, laser printing equipment and feed through copy machines prior to folding the panel in order to form an envelope Before the panel is folded, the panel, peel-off backing sheet, and peel-off strip attached to an adhesive strip on the envelope's closure flap provide a flat sheet of uniform thickness which can be easily processed through printing and copying equipment. After indicia is printed on the panel or copying is completed, an envelope may be formed by peeling the single backing sheet off the pressure sensitive strips, folding the envelope about a fold line located near the middle of the panel, and pressing the strips of pressure sensitive adhesive at the sides of the panel together so that a pocket is formed for holding a letter or other document. The strip covering the adhesive on the closure flap is then peeled off and the closure flap is folded about another fold line at the bottom of the flap allowing the adhesive on the flap to be pressed against the panel and the flap to be closed.

The various features of the present invention will be best understood together with further objects and advantages by reference to the following description of the preferred embodiment taken in conjunction with the accompanying drawings.

BRIEF DESCRIPTION OF THE DRAWINGS

FIG. 1 is a front perspective view of an envelope illustrating the principles of the present invention showing a panel of the envelope folded to form the envelope and a closure flap held shut by pressure sensitive adhesive, so that the envelope may be used to mail a letter;

FIG. 2 shows how a peel-off strip may be removed from the closure flap of the envelope exposing a strip of pressure sensitive adhesive;

FIG. 3 is a front elevational view of the panel used for the envelope showing the panel in an unfolded state;

DESCRIPTION OF THE PREFERRED EMBODIMENT

The following specification taken in conjunction with the drawings sets forth the preferred embodiment of the present invention in such a manner that any person skilled in the art can make and use the invention. The embodiment of the invention disclosed herein is the best mode contemplated by the inventors for carrying out their invention in a commercial environment although it should be understood that various modifications can be accomplished within the parameters of the present invention.

FIGS. 1–3 show a preferred embodiment of the envelope 10 of the present invention. A front view of a panel 12 is shown in FIG. 3 as a flat, unfolded sheet of material which is used to form the envelope 10. The panel 12, made of a sheet of material such as paper, has upper and lower fold lines 14 and 16 respectively. The fold lines 14 and 16 are preferably formed by lines of perforations in the sheet material. However, lines 14 and 16 may be formed by any desirable method such creases in the sheet material, or the like. The perforations may be unevenly spaced along lines 14 and 16, if desired, to increase the strength of the sheet material along these lines.

Figure 4:
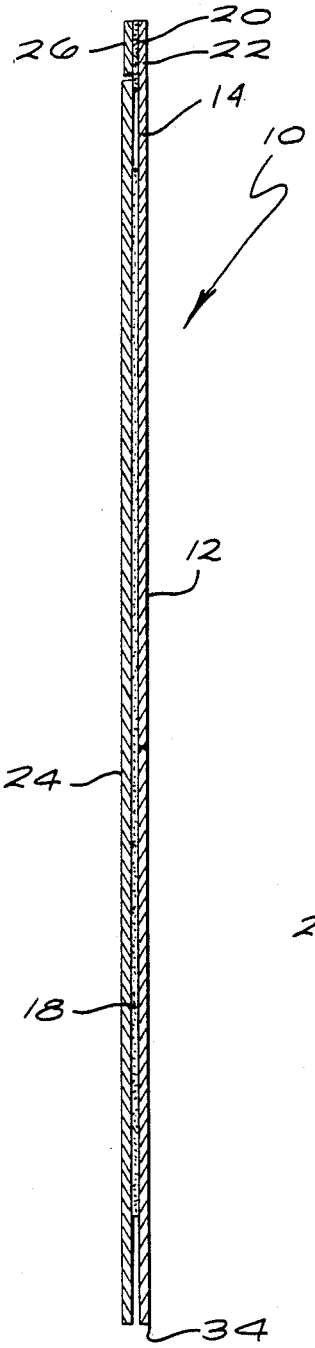
FIG. 4 is a cross-sectional view of the panel of FIG. 3, taken along the section IV-13 IV of FIG. 3.
Figure 6:
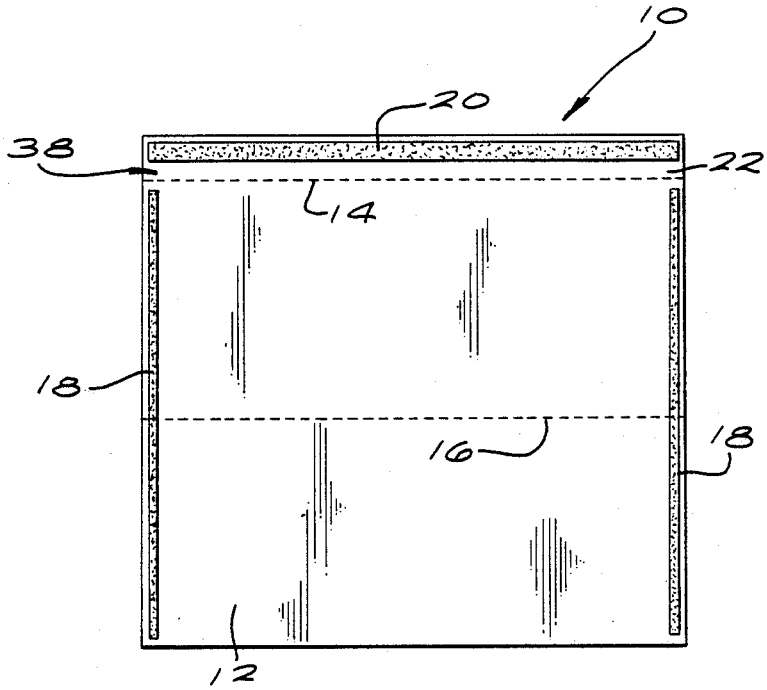
FIG. 6 is a rear elevational view of the envelope panel showing strips of pressure-sensitive adhesive extending along the sides of the panel and a strip of pressure sensitive adhesive running along the length of the closure flap.

Referring now to FIGS. 4 and 6, a rear view of the panel 12 is shown having strips of adhesive 18 running vertically along the sides of the panel 12, and a horizontal strip of adhesive 20 extending along the length of a closure flap 22 formed integrally as part of the panel 12 and located above fold line 14. A single peel-off backing sheet 24, substantially the same size as the panel 12 below fold line 14, covers the adhesive strips 18. Vertical strips 18 are shown extending almost to the bottom of the panel 12, and almost all the way to upper fold line 14. In addition, horizontal strip 20 is shown extending almost all the way across closure flap 22. However, the horizontal strips of adhesive 20 may extend only part of the way across flap 22 if desired. Also, vertical strip 18 may extend only part of the way up and down the sides of the panel 12 if desired. For example, it is preferable that gaps exist between the top of the vertical strips 18 and the fold line 14 and between the bottom of horizontal strip 20 and the fold line 14, resulting in a gap 38 between the top of each strip 18 and the bottom of strip 20. Gaps 38 provide easy access for a letter opener when flap 22 is shut. Gap 38 is preferably ½ inch, but may be varied as desired.

Preferably, the panel 12 and backing sheet 24 are generally rectangular-shaped and are substantially the same size. However, the top of backing sheet 24 may extend above fold line 14, if desired, and may cover part of adhesive strip 20 as shown in FIG. 4. Panel 12 is preferably about 9¼ inches wide by about 7¾ inches high. The distance between fold lines 14 and 16 is preferably about 4 inches, and the distance between fold line 16 and bottom 34 of the panel 12 is preferably about 3¾ inches. Closure flap 22 is preferably about ¾ inch high.

The peel-off backing sheet 24 may be used to cover a sticky adhesive used for strip 18 and peeled off for the purpose of folding the panel as discussed below. The peel-off backing sheet 24 is preferably covered by a release material such as silicone so that it may be easily removed from the sticky adhesive strips 18. The envelope 10 will be subjected to higher temperatures during laser printing or by the hot rollers of a xerographic copying machine. As a result, the sticky adhesive is preferably a stable, pressure-sensitive adhesive of a type which will not flow at a temperature of a few hundred degrees Fahrenheit. However, it is preferred that the pressure-sensitive adhesive will remain stable when subjected to temperatures in the range of up to about 300 to about 400 degrees Fahrenheit.

It is important to note that the invention is not intended to be limited by the type of adhesive used or by the location of the adhesive on the panel 12. For example, only part of closure flap 22 may be covered by adhesive, or adhesive strips 18 may only extend above or below fold line 16.

As mentioned above, the peel-off backing sheet 24 covers the adhesive strips 18 and the portion of panel 12 below fold line 14. In addition, a smaller peel-off strip 26 is used to cover adhesive strip 20 on the closure flap 22. Peel-off strip 26 is preferably made out of the same material as used for peel-off backing sheet 24 and is covered by a silicone release material for easy removal from adhesive strip 20.

Preferably, the single peel-off backing sheet 24 has a silicone coating on only one side which allows a person to print or write on the other side of the backing sheet. As such, the backing sheet 24 may be used as stationery or a letter and placed inside the envelope 10 for mailing.

As best illustrated by FIG. 4, the panel 12, peeloff strip 26, and peel-off backing sheet 24 provide a flat sheet of uniform thickness when attached together as shown because the panel 12 and sheet 24 are substantially the same size. Such a uniform thickness facilitates processing through automatic mechanical sheet feed printing equipment, laser printing equipment, feed through copy machines and ink-jet sheet printers.

Figure 5:
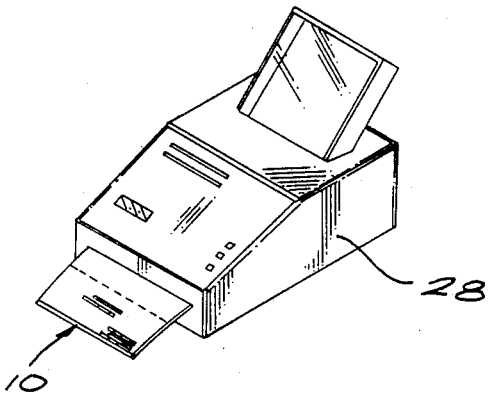
FIG. 5 is a perspective view of a laser printer showing the envelope panel being processed through the printer.

FIG. 5 shows an envelope 10 being processed through a laser printer 28 while the panel 12, peel-off strip 26 and peel-off backing sheet 24 are still attached together before the panel 12 is folded as explained below. When fed through a laser printer 28, indicia may be printed on the front side of the panel 12 as shown in FIGS. 1 and 3 such as a return address 30 and the address 32 of the person to whom the letter 10 is being sent.

Figure 7:
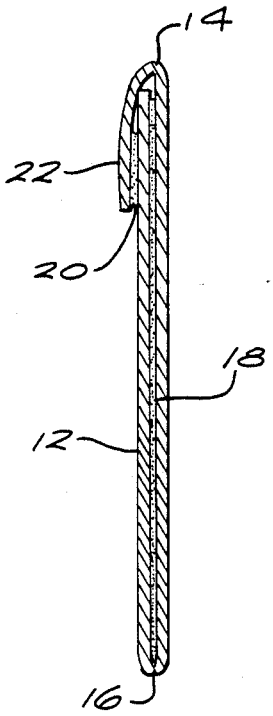
FIG. 7 is a cross-sectional view of the envelope taken in the direction of arrows VII—VII shown in FIG. 1.

After the panel 12 is printed with indicia such as the addresses 30 and 32, the backing sheet 24 may be peeled from panel 12. Panel 12 may then be folded along lower fold line 16 so that the bottom 34 of the panel 12 is adjacent to upper fold line 14 as shown in FIG. 2. Note that fold line 16 is located on the panel 12 approximately half way down the portion of panel 12 below fold line 14 so that bottom 34 will end up adjacent fold line 14 after the panel 12 is folded. Since the backing sheet 24 has been removed, the adhesive strips 18 at the sides of the envelope 10 stick together when pressed together so that a pocket 36 is formed for holding a letter, or other documents, as shown in FIG. 2. Peel-off strip 26 may then be removed exposing adhesive strip 20, which may be used to close flap 22 by folding it along upper fold line 14 located at the bottom of the flap 22 and pressing the adhesive strip 20 against the panel 12 as shown in FIGS. 1 and 7.

As such, the panel 12 and closure flap 22 may be easily folded about fold lines 14 and 16 to form the envelope 10 after the peel-off backing sheet 24 and strip 26 have been removed. However, an important feature of the invention allows indicia to be printed on the front side cf the panel 12 before the backing sheet 24 and strip 26 are removed as explained above. The simplicity of the design provides an envelope that is economical to manufacture, but still allows indicia to be printed on the envelope when automatic mechanical sheet feed printing equipment and laser printing equipment are used, and permits feed through copy machines to be used after indicia has been printed on the envelope.

The above description discloses the preferred embodiment of the present invention. However, persons of ordinary skill in the art are capable of numerous modifications once taught these principles. For instance, by way of example and not imitation, different numbers of adhesive strips may be used for the envelope and the lengths and positions of the strip may vary as desired.

Accordingly, it will be understood by those skilled in the art that changes in form and details may be made to the above-described embodiment without departing from the spirit and scope of the invention.

I claim:

1. An envelope comprising:

a paper panel having a top, bottom and two sides, said panel having a strip of adhesive extending along each of said sides;

an elongated strip of paper integrally joined to said top of said panel, said elongated strip having a strip of adhesive extending parallel to said top of said panel;

a strip of material covering said strip of adhesive on said elongated strip of paper; and a backing sheet covering said strips of adhesive at said sides of said panel, said backing sheet being substantially a same size as said panel, said panel having a first, fold line where said elongated strip of paper is integrally joined to said top of said panel and a second fold line disposed parallel to said first fold line and located approximately half way down said panel between said first fold line and said bottom of said panel, said panel capable of being folded about said first and second fold lines to form said envelope after said backing sheet and said strip of material on said elongated strip of paper are peeled from said strips of adhesive.

2. The envelope of claim 1 wherein said panel, said backing sheet, said strip of material on said elongated strip and said elongated strip form a sheet of substantially uniform thickness when attached together, said uniform thickness facilitates the use of automatic mechanical sheet feed printing equipment, laser printing and feed through copy equipment in conjunction with the envelope.

3. The envelope of claim 2 wherein said adhesive is a stable, pressure sensitive adhesive.

4. The envelope of claim 2 wherein said stable, pressure sensitive adhesive is not activated by a temperature in the range of about 200 degrees Fahrenheit to about 400 degrees Fahrenheit.

5. The envelope of claim 1 wherein said backing sheet has a silicone coating on only one side thereof, allowing printing on the other side thereof.

6. The envelope of claim 1 wherein a qap exists between the top of each of said strips of adhesive extending along each of said sides and the bottom of said strip of adhesive extending parallel to said top of said panel.

7. An envelope comprising:

a panel of sheet material having a top, bottom and two sides;

a closure flap integrally joined to said top of said panel, said panel having a first fold line along to said top of said panel where said panel is integrally joined to said closure flap and a second fold line about half way down said panel between said top and said bottom of said panel, said first fold line being parallel to said second fold line;

first adhesive strip means located along said sides of said panel for attaching corresponding portions of said sides of said panel together when said panel is folded about said second fold line in order to form said envelope;

second adhesive strip means located on said closure flap for closing said flap shut;

a strip of material covering said second adhesive strip means, said strip of material capable of being peeled from said second adhesive strip means; and a backing sheet covering said first adhesive strip means, said backing sheet capable of being stripped from said first adhesive strip means, said backing sheet being substantially a same size as said panel.

8. The envelope of claim 7 wherein each of said first and second adhesive strip means is a stable, pressure sensitive adhesive.

9. The envelope of claim 8 wherein said stable, pressure sensitive adhesive is not activated by a temperature in the range of about 200 degrees Fahrenheit to about 400 degrees Fahrenheit.

10. The envelope of claim 9 wherein said panel and said backing sheet are generally rectangular-shaped.

11. The envelope of claim 10 wherein said panel, said backing sheet, said strip of material on said closure flap and said closure flap form a sheet of substantially uniform thickness when attached together.

12. The envelope of claim 11 wherein said sheet material is paper.

13. An envelope comprising:

a panel of sheet material having a top, bottom and two sides;

a closure flap, said closure flap being an elongated strip of sheet material integrally joined to said, panel at said top of said panel, said closure flap integrally joined to said panel at a first fold line coinciding with said top of said panel, said panel having a second fold line running parallel to said first fold line and located approximately half way down said panel between said first fold line and said bottom of said panel, said panel having a strip of adhesive running along each of said two sides, said closure flap having a strip of adhesive running parallel to said first and second fold lines;

a strip of material covering said strip of adhesive on said closure flap and capable of being peeled from said strip of adhesive; and a backing sheet- covering said strips of adhesive at said sides of said panel and capable of being peeled from said strips of adhesive at said sides, said backing sheet being substantially a same size as said panel, said panel, said backing sheet, said closure flap and said strip of material on said closure flap forming a sheet of substantially uniform thickness which facilitates printing on said panel and copying of indicia on said panel, said panel capable of being folded along said first and second fold lines in order to form said envelope after said backing sheet is peeled from said strip of adhesive at said sides and said strip of material covering said strip of adhesive on said closure flap is removed.

14. The envelope of claim 13 wherein said adhesive is a stable, pressure sensitive adhesive.

15. The envelope of claim 14 wherein said stable, pressure sensitive adhesive is not activated by a temperature of about a few hundred degrees Fahrenheit.

16. The envelope of claim 14 wherein said stable, pressure sensitive adhesive is not activated by a temperature in the range of up to about 300 to about 400 degrees Fahrenheit.

17. The envelope of claim 13 wherein said sheet material is paper.

18. The envelope of claim 13 wherein said panel and said backing sheet are generally rectangular-shaped.

19. The envelope of claim 18 wherein said backing sheet and said panel are about $9\frac{1}{4}$ inches wide by about $7\frac{3}{4}$ inches high.

20. The envelope of claim 13 wherein a distance between said first and second fold lines is about 4 inches and a distance between said second fold line and said bottom of said panel is about $3\frac{3}{4}$ inches.

* * * * *